US007946787B2

(12) United States Patent
Glee et al.

(10) Patent No.: US 7,946,787 B2
(45) Date of Patent: May 24, 2011

(54) PAVING SYSTEM AND METHOD

(75) Inventors: Katherine C. Glee, Dunlap, IL (US); Aaron Donnelli, Germantown Hills, IL (US)

(73) Assignee: Caterpillar Inc., Peoria, IL (US)

( * ) Notice: Subject to any disclaimer, the term of this patent is extended or adjusted under 35 U.S.C. 154(b) by 298 days.

(21) Appl. No.: 12/215,472

(22) Filed: Jun. 27, 2008

(65) Prior Publication Data

US 2009/0324331 A1 Dec. 31, 2009

(51) Int. Cl.
*E01C 23/07* (2006.01)

(52) U.S. Cl. ..... 404/84.8; 404/75; 404/84.05; 404/84.1; 404/84.5

(58) Field of Classification Search ..... 404/82–85
See application file for complete search history.

(56) References Cited

U.S. PATENT DOCUMENTS

| | | | | |
|---|---|---|---|---|
| 3,678,817 | A | 7/1972 | Martenson et al. | |
| 4,759,657 | A | 7/1988 | Dorr et al. | |
| 5,356,238 | A | 10/1994 | Musil et al. | |
| 5,362,177 | A | 11/1994 | Bowhall et al. | |
| 5,393,167 | A * | 2/1995 | Fujita et al. | 404/84.1 |
| 5,549,412 | A | 8/1996 | Malone | |
| 5,568,992 | A | 10/1996 | Grembowicz et al. | |
| 5,599,134 | A | 2/1997 | Macku et al. | |
| 5,702,201 | A | 12/1997 | Macku et al. | |
| 5,735,634 | A * | 4/1998 | Ulrich et al. | 404/102 |
| 5,752,783 | A | 5/1998 | Malone | |
| 5,879,104 | A | 3/1999 | Ulrich | |
| 5,984,420 | A | 11/1999 | Murray et al. | |
| 6,352,386 | B2 | 3/2002 | Heims | |
| 6,520,715 | B1 | 2/2003 | Smith | |
| 6,742,960 | B2 | 6/2004 | Corcoran et al. | |
| 6,749,364 | B1 | 6/2004 | Baker et al. | |
| 6,799,922 | B2 | 10/2004 | Smith | |
| 6,916,070 | B2 | 7/2005 | Sehr | |
| 7,044,680 | B2 | 5/2006 | Godbersen et al. | |
| 7,172,363 | B2 | 2/2007 | Olson et al. | |
| RE39,834 | E | 9/2007 | Kieranen et al. | |

(Continued)

FOREIGN PATENT DOCUMENTS

EP 1 840 506 A1 3/2007

(Continued)

OTHER PUBLICATIONS

Glee et al., Paving System and Method, pending U.S. Appl. No. 11/998,660 (25 pages) and drawings (4 pages), filed Nov. 30, 2007.
Daniel Brown, Buiding Super-Smooth Asphalt Pavements, Better Roads, Mar. 2008, 6 pages.

*Primary Examiner* — Raymond W Addie
(74) *Attorney, Agent, or Firm* — Liell & McNeil

(57) ABSTRACT

A paving system includes a machine having a frame with a plurality of ground-engaging elements coupled with the frame, and a height adjustable screed coupled with the frame. The paving system may also include a paving control system having a receiver configured to receive screed control data indicative of a position of the height adjustable screed relative to a reference position. The paving control system may further include a computer readable memory storing a control algorithm, which may include a smoothness estimating algorithm and a screed adjusting algorithm. An electronic control unit is coupled with the computer readable memory and is configured via the control algorithm to determine a smoothness value for a region of a mat of material which corresponds with an irregular pattern of screed position, in response to screed control data received via the receiver.

20 Claims, 3 Drawing Sheets

U.S. PATENT DOCUMENTS

| | | | | |
|---|---|---|---|---|
| 2003/0000091 | A1 | 1/2003 | Havenstein et al. | |
| 2003/0194273 | A1 | 10/2003 | Lloyd | |
| 2006/0045620 | A1* | 3/2006 | Olson et al. | 404/84.1 |
| 2007/0239336 | A1 | 10/2007 | Congdon et al. | |
| 2007/0239338 | A1 | 10/2007 | Potts et al. | |
| 2008/0063473 | A1 | 3/2008 | Congdon et al. | |

FOREIGN PATENT DOCUMENTS

| | | |
|---|---|---|
| JP | 05061211 | 8/1993 |
| KR | 100243072 | 2/2000 |

* cited by examiner

PAVING SYSTEM AND METHOD

TECHNICAL FIELD

The present disclosure relates generally to the field of paving, and relates more particularly to determining a smoothness value for a region of a mat of paving material responsive to screed control data.

BACKGROUND

A wide variety of paving practices and specialized equipment has been developed over the years in an attempt to optimize paving quality. Paving contractors are often tasked with meeting certain project specifications relating to paving quality. If specifications are met or exceeded, the paving contractor may receive bonus payments. If specifications are not met, at minimum bonus payments may be forfeited, and in some instances expensive and lengthy rework of a construction site may be required. Moreover, in recent years there has been a trend toward increasing contractor responsibility for long-term pavement durability. One factor increasingly recognized as important to the durability of a paved surface over many years is smoothness. Careful pre-paving preparation of the surface to be paved can level the grade and reduce irregularities in the surface profile. Level grades and relatively regular surface profiles tend to result in enhanced smoothness of a mat of paving material placed upon the surface. Nevertheless, there are limitations to the extent to which contractors can practicably prepare a surface prior to paving. Different contractors are also often responsible for preparation of the surface to be paved versus actual paving of the surface, tending to disperse responsibility among unrelated parties. Limitations in the controllability of machines used in paving systems can also affect the achievable smoothness for a given paving project.

As alluded to above, in many instances the surface to be paved may have an irregular profile, even after preparation via one or more passes with a cold planer, reclaimer, recycler, or other machine. Numerous examples of machine hardware and controls are known in the art which attempt to compensate for irregularities in the profile of a surface to be paved. In one conventional technique, the relative height of a screed of a paving machine may be varied to control the amount of paving material deposited by the paving machine as it passes over a surface. Bumps, dips and other irregularities can be under-filled, over-filled, etc., to lessen the extent to which a mat of paving material reflects the irregularities in the surface. An instrument known as an averaging ski is often coupled with a paving machine, and provides data to the paving machine which indicates the presence of changes in a profile of the surface to be paved. The paving machine operator or control system can adjust screed height in response to data from the averaging ski to achieve a smoother mat than might otherwise be possible. Sonic sensors, stringlines and other mechanisms for providing data used in controlling and monitoring the screed and other aspects of a paving system are also well known and used with increasing frequency in the paving arts.

In addition to varying the processes, controls and hardware used in paving to optimize smoothness and other aspects of paving quality, engineers have developed a variety of means for measuring the smoothness of a surface once it has been paved. Smoothness measurements may be used to verify whether project specifications have been met, and to validate paving strategies intended to provide smooth results. One common practice is to use a relatively complex and expensive piece of equipment known as an inertial profiler or a simpler California Profilograph. The apparatus is typically pushed or towed and includes one or more sensors to sense changes in the profile of a surface. Either type of smoothness measurement may be used during paving to measure smoothness as paving progresses, by the paving contractor, third parties contracted to measure smoothness values or by Department of Transportation personnel to assess whether a particular paving project has met or exceeded smoothness specifications. While profilographs have been shown to be effective, they have certain shortcomings, notably expense, and can be unwieldy when used during paving or to transport. U.S. Pat. No. 5,549,412 to Malone is one example of a paving system using a profiling device in conjunction with the paving machine. In Malone, a profiler is used to collect data on a base surface. An asphalt paver is provided with a similar profiler that measures smoothness of a fresh mat of asphalt laid by the paver. In Malone, profiler and paver position are determined via GPS, and smoothness of the mat may be plotted based on data inputs from the profilers. Malone's system may be suited to its intended purpose, but is relatively complex, expensive and unwieldy.

SUMMARY

In one aspect, a method of operating a paving system includes a step of receiving screed control data which is indicative of an irregular pattern of screed position relative to a reference position, for a screed of the paving machine. The method still further includes a step of determining a smoothness value, responsive to the screed control data, for a region of a mat of paving material which corresponds with the irregular pattern of screed position.

In another aspect, a paving control system includes a receiver configured to receive screed control data indicative of a position of a height adjustable screed of a paving machine relative to a reference position. The paving control system further includes a computer readable memory storing a control algorithm including computer executable code, and an electronic control unit coupled with the receiver and with the computer readable memory. The electronic control unit is configured via executing the-control algorithm to determine a smoothness value for a region of a mat of material which corresponds with an irregular pattern of screed position, in response to the screed control data.

In still another aspect, a paving system includes a machine having a frame with a height adjustable screed coupled with the frame, and a receiver configured to receive screed control data indicative of an irregular pattern of screed position relative to a reference position, for the height adjustable screed. The paving system further includes an electronic control unit in communication with the receiver and configured to receive the screed control data during paving a surface with a mat of material via the paving system. The electronic control unit is further configured to determine a smoothness value for a region of the mat of material which corresponds with the irregular pattern of screed position, in response to the screed control data.

DETAILED DESCRIPTION

Figure 1:
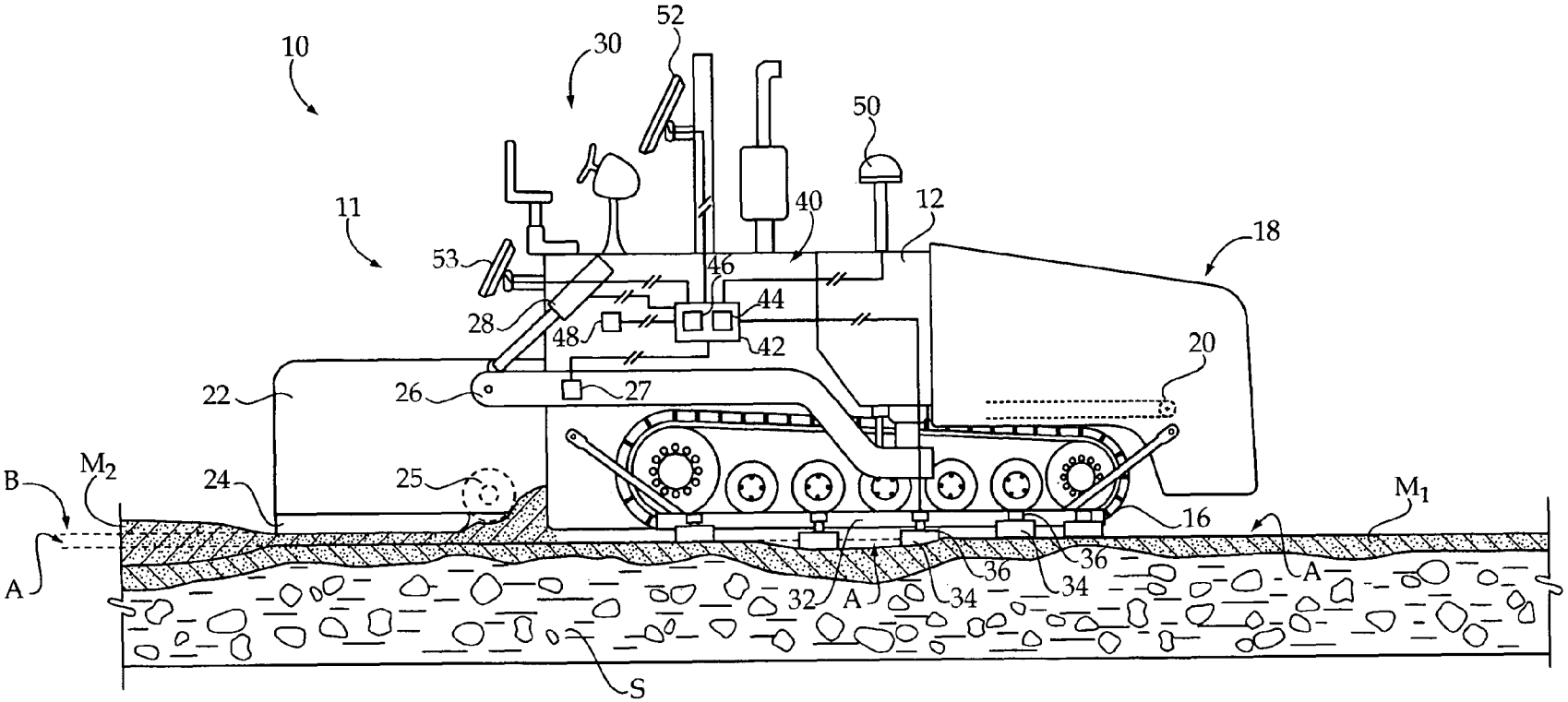
FIG. 1 is a side diagrammatic view of a paving system, according to one embodiment.

Referring to FIG. 1, there is shown a paving system 10 according to one embodiment. Paving system 10 may include a paving machine 11 having a frame 12 with a set of ground-engaging elements 16, such as wheels or tracks, coupled with frame 12. Paving machine 11 may further include a hopper 18 adapted for storing a paving material, and a conveyor 20 configured to move paving material from hopper 18 through paving machine 11, to deposit the paving material on a surface in a conventional manner. Paving machine 11 may further include a distribution auger 25 which receives paving material supplied via conveyor 20 and distributes the paving material, also in a conventional manner. Paving machine 11 may further include an operator station 30, and a tow arm 26 coupling a height adjustable screed 22, having a screed plate or shoe 24, with frame 12. A set of screed actuators 28 may be provided which can control raising or lowering of tow arm 26 to allow screed height to be adjusted. Paving machine 11 may be configured to vary a position of screed 22, in particular screed shoe 24, relative to a reference position, to control a thickness of paving material deposited via paving machine 11. The reference position may be an imaginary plane "B" as shown in FIG. 1. In one embodiment, plane B might be associated with or be defined by a stringline, a laser grading system, or any other suitable local or global positioning system.

In the FIG. 1 illustration, paving machine 11 is in the process of paving a lift of material $M_2$, on top of another lift of material $M_1$ overlying a subgrade "S." Together, lifts $M_1$ and $M_2$ comprise a paving material mat. It will be noted that subgrade S includes an irregular profile, defined by a series of bumps and dips, etc., therein. Lift $M_1$ also has an irregular profile that is similar to the irregular profile of subgrade S, including bumps and dips, etc., which correspond with the bumps and dips of subgrade S. The irregularity of the profile of lift $M_1$ is less severe than the irregularity of the profile of subgrade S. In other words, in depositing lift $M_1$ on top of subgrade S, the bumps, dips, etc., are attenuated relative to the bumps, dips, etc., of subgrade S. By controlling a position of screed 22 relative to reference plane B, a thickness of lift $M_1$ can be varied to compensate in part for the irregular profile of subgrade S. Screed 22 can be adjusted to deposit paving material of lift $M_1$ via paving machine 11 at a thickness which varies inversely with the irregular profile of subgrade S. In other words, lift $M_1$ may be deposited at a relatively greater thickness over dips, grooves, holes, etc., in subgrade S, and at a relatively lesser thickness over bumps, rises and the like. This general technique of varying the thickness of the lift of paving material enables attenuation, and to a certain extent elimination, of irregularities in the profile of the mat. Each lift of material $M_1$, $M_2$ and possibly additional lifts will typically reflect fewer of the irregularities in subgrade S and less severity in irregularity than the preceding lift, therefore incrementally increasing the smoothness of the mat of paving material with each lift. Thus, lift $M_1$ will tend to be smoother than subgrade S, lift $M_2$ will tend to be smoother than lift $M_1$, and so on. Subgrade S may also be prepared in advance of paving to render the profile of subgrade S as smooth as possible, although as discussed above there are limitations to the extent to which subgrade S can, at least in practicality, be made smooth. In any event, it will be readily apparent that screed 22 will be moved vertically up and down relative to reference plane B as paving progresses, defining an irregular pattern of screed position relative to plane B. In one embodiment, the irregular pattern of screed position may be an inverse of the profile of subgrade S, as thickness of lifts $M_1$ or $M_2$ is varied to compensate for the irregular profile of subgrade S.

Paving machine 11 may further include a variety of control components and hardware for implementing the above screed control technique. In one embodiment, paving machine 11 may include an averaging ski 32 which is coupled with frame 12, and includes a plurality of movable ski elements 34. A set of sensors may be associated with averaging ski 32, including for example a plurality of sensors 36 coupled one with each of movable ski elements 34. A second set of sensors may be associated with screed tow arm 26, including for example a plurality of screed tow arm sensors 27. Sensors 27 and sensors 36 may be components of a paving control system 40 which is configured, among other things, to control screed 22. Control system 40 may also include a display 52 which is viewable at operator station 30 and/or another display 53 viewable at a screed controller station (not numbered) of paving machine 11, the significance of which will be apparent from the following description. Either or both of displays 52 and 53 may be used in controlling or monitoring paving activities of paving system 10, as described herein. A receiver 50 may be mounted on frame 12, which is configured to receive data, such as global or local positioning data, control commands for paving machine 11, etc. Each of display 52, receiver 50, and sensors 36 and 27 may be in communication with an electronic control unit 42 of control system 40. Electronic control unit 42 may include a data processor 44 and a memory writing device 46, and may be coupled with a computer readable and writable memory 48. In the embodiment shown, control system 40 is resident on paving machine 11, however, it should be appreciated that paving system operating and control strategies according to the present disclosure could be practiced by collecting, storing and processing data via sensors, computers, etc., which are not resident on paving machine 11, such as at a worksite office or the like.

During operation of paving system 10, electronic control unit 42 may receive signals from averaging ski sensors 36 which are indicative of a surface profile of subgrade S, lift $M_1$ or lift $M_2$, depending upon which surface paving machine 11 is traveling over and paving. Since averaging ski 32 may include a plurality of movable ski elements 34, changes in the profile of the surface to be paved may be averaged approximately over a length of averaging ski 32. Positions of movable ski elements 34 relative to a reference position, such as another reference plane "A" may be monitored. Electronic control unit 42 may receive electronic input data from averaging ski sensors 36, and may calculate or otherwise determine screed control commands based thereon. Thus, electronic control unit 42 may comprise a receiver, such as data processor 44 which is configured to receive input data for determining screed control commands. In other embodiments, rather than an averaging ski, input data for determining screed control commands could be collected via a different system, such as via a scanner mounted on paving machine 11, or a profiler or other machine moved across the surface to be paved in advance of paving machine 11 which obtains profile data for subgrade S, lift $M_1$ or $M_2$, etc. In still other embodiments, a cold planer, reclaimer, etc., might record data associated with the profile of subgrade S, lift $M_1$, $M_2$, etc. Electronic control unit 42, or an electronic control unit not resident on paving machine 11, could receive the electronic data from the cold planer, reclaimer, etc., and use the electronic data in determining the screed control commands.

Electronic control unit 42 may, via memory writing device 46, store the screed control data on computer readable memory 48. Determining screed control commands could take place, for example, by determining an average elevation of a given segment of the surface to be paved relative to a reference elevation, then determining an appropriate height for screed 22 relative to a reference height when paving the given segment of the surface to be paved. Regardless of whether the input data used for controlling the screed is received from sensors 32, from sensors on a different machine, or via some other means, electronic control unit 42 may output screed control commands responsive to the input data. The screed control commands may be output via electronic control unit 42 to actuator(s) 28 to adjust screed 22 accordingly. Adjusting of a vertical position of screed 22 may be commanded in advance of screed 22 actually reaching the subject segment of the surface to allow time for the control commands to take effect.

The term "screed control data" as used herein should be understood to include a variety of types of electronic data, including the input data for use in determining screed control commands as described above. In addition, electronic control unit 42 may receive response data which is indicative of a response of screed 22 to the screed control commands, and is thus also a form of screed control data. In one embodiment, tow arm sensors 27 can output response data indicative of a position of screed 22 relative to a reference position. Further, the screed control commands themselves, or corresponding signal values, may be understood as screed control data as described herein. It will be recalled that screed 22 may have an irregular pattern of position relative to a reference position such as reference plane B during paving. The input data, response data and screed control commands are therefore each examples of screed control data which is indicative of the irregular pattern of screed position relative to the reference position.

Figure 2:
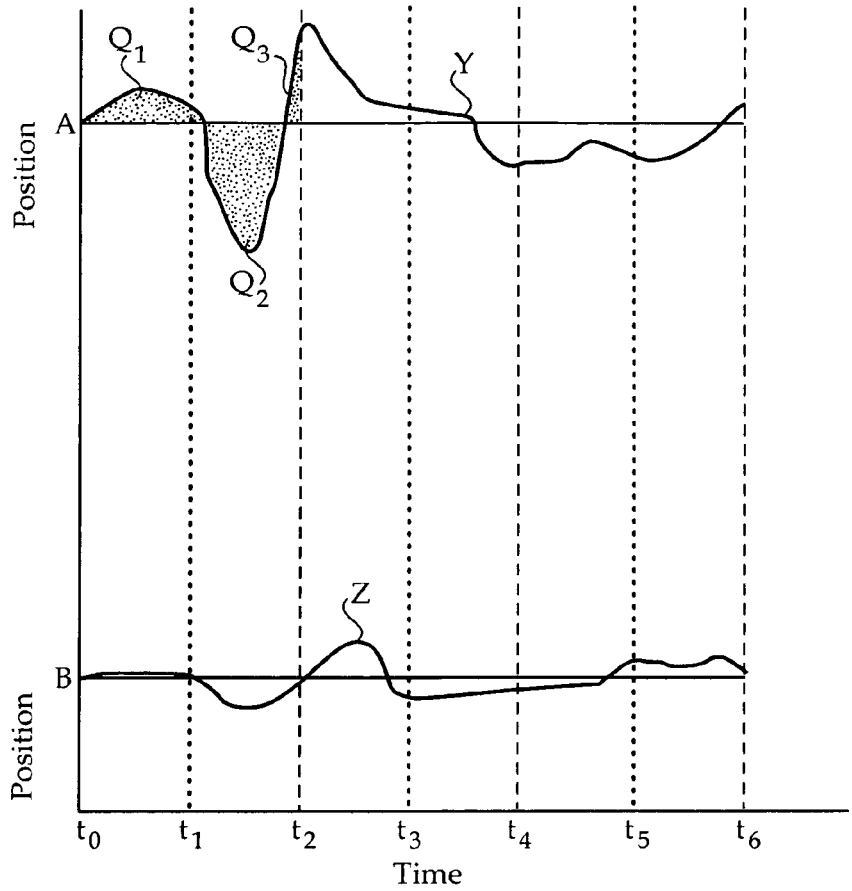
FIG. 2 is a graph illustrating example signal traces corresponding to screed control data in a paving system, according to one embodiment.

Referring also to FIG. 2, there is shown a graph including example signal traces corresponding to screed control data comprising input data, line Y, and screed control data comprising response data, line Z. In particular, in FIG. 2 position is plotted on the Y-axis, over a plurality of time increments, $t_0$-$t_1$, $t_1$-$t_2$, $t_2$-$t_3$, $t_3$-$t_4$, $t_4$-$t_5$ and $t_5$-$t_6$ shown on the X-axis. Line Y represents input data from sensors 36 which is indicative of an average position of movable ski elements 34 relative to a reference position, such as reference plane A. Line Z represents response data from sensors 27 which is indicative of a position of screed 22 relative to a reference position, such as reference plane B. During operating paving system 10, electronic control unit 42 may receive the input data corresponding to line Y and responsively calculate screed control commands. Electronic control unit 42 may further receive response data corresponding to line Z. The response data could be used via closed loop control in positioning screed 22 as desired, and may also be used to determine an actual screed position which serves as a starting point for commanding screed adjustment. In other words, the response data may be used to determine where screed 22 is, so that electronic control unit 42 can determine how much screed 22 should be adjusted to reach a desired position. It may be noted in FIG. 2 that line Z is approximately the inverse of line Y, but out of phase with line Y and reduced in amplitude. During a paving process, such as that represented in FIG. 1, data from averaging ski sensors 36 generally indicates a profile of lift $M_1$.

Data from tow arm sensors 27 generally indicates a profile of lift $M_2$, prior to compaction via a compactor. The thickness of any given lift, such as lift $M_2$, at least prior to compaction with a compactor, will typically vary inversely with the profile of the underlying substrate, hence, lines Y and Z are approximately inverse relative to one another. Lines Y and Z are out of phase with one another since screed 22 encounters a given geographic area later in time than averaging ski 32, and because screed 22 will typically not reach a commanded position immediately but instead will be delayed by about five tow arm lengths in many embodiments. In other words, when a change in vertical position of screed 22 is commanded, screed 22 may not actually reach the commanded position until paving machine 11 has traveled a forward distance equal to about five times the length of tow arm 26. In other paving machine designs, the distance required for a screed to respond to commands based on data from an averaging ski may be different from five tow arm lengths. This phenomenon will be familiar to those skilled in the paving arts. As discussed above, the varying thickness of lift $M_2$ compensates in part for the irregular profile of lift $M_1$, hence the attenuated amplitude of line Z relative to line Y. It should be appreciated that the screed control data, and signal amplitudes, phasing, etc., represented in FIG. 2 are purely illustrative, and shown herein only to represent certain types of screed control data which may be used as described herein.

It has been discovered that screed control data as described herein may be used to determine or estimate a smoothness of a mat of paving material being deposited via paving machine 11, in real time. Rather than relying upon expensive and unwieldy profilographs and the like, an operator or site manager may be provided with a means to assess smoothness while paving, such that operation of paving system 10 can be adjusted or maintained to optimize paving quality. Real time smoothness estimating can also allow the operator or site manager to have an idea in advance of an expected smoothness for a particular project or portion of a project prior to completion. Smoothness estimates or calculations might also be logged to verify that specifications have been met for a particular project, or for future forensic and research purposes. As will be further apparent from the following description, smoothness values corresponding to a present smoothness, a smoothness after compacting or even a predicted smoothness at some point in the future after subjecting a mat to traffic, time and weather, etc., may all be determined via electronic control unit 42 or another computer via processing the screed control data as described herein. Thus, the term "smoothness value" should be broadly construed to mean essentially any quantitative or qualitative value that represents a present or future smoothness of a mat of paving material. The smoothness value could be an estimate or correlated to the International Roughness Index in one embodiment, or it could be a value on another numerical or other quantitative or qualitative scale.

To this end, computer readable memory 48 may store a control algorithm comprising computer executable code, which is executed via electronic control unit 42 to determine a mat smoothness value for a region of a mat of material which corresponds with an irregular pattern of screed position relative to a reference position. "Corresponds with" should be understood to mean that the smoothness value is geographically associated with, or may be geographically associated with, a region of a mat of paving material. The region of the mat might be a sub-region or it might be the entire mat. As also discussed above, electronic control unit 42 may comprise a receiver which receives screed control data indicative of a position of screed 22 relative to a reference position such as reference plane B from at least one of sensors 27 and sensors 36. As discussed above, signals from averaging ski sensors 36 may be understood as input data used in determining screed control commands via electronic control unit 42 for controlling screed 22. Signals from sensors 27 may be understood as response data indicative of a response of screed 22 to the screed control commands. Either or both of the input data and the response data, as well as the screed control commands themselves, may be leveraged to provide a calculation or estimate of mat smoothness, corresponding to a mat smoothness value as mentioned above, while paving is progressing.

The smoothness value may thus further be understood as being determined in response to screed control data which is indicative of the irregular pattern of screed position. It will be recalled that receiver 50 may be used to receive position data indicative of a position of paving machine 11. By incorporating position data received via receiver 50, electronic control unit 42 may be further configured to map a smoothness value to a given region of a surface being paved and output a smoothness mapping signal. The smoothness mapping signal or corresponding signal value may be stored for future reference, or sent to display 52 or display 53 to allow an operator to view the results of ongoing paving. Embodiments are contemplated wherein mat smoothness values will be determined and updated essentially continuously, as well as embodiments wherein mat smoothness values are determined periodically based on elapsed paving time or based on a distance traveled via paving machine 11. In one further embodiment, a plurality of smoothness values, such as a first value representing an average smoothness for an entire paving project, a second value representing a smoothness over the last fifty meters, for example, and still others might be calculated or otherwise determined, and logged in memory 48 or communicated to an operator, or both. The smoothness information could also be communicated to an off-site data area for interpretation or analysis, or archived.

In one further embodiment, the control algorithm recorded on computer readable memory 48 may include a screed adjusting algorithm, and electronic control unit 42 may be configured via executing the screed adjusting algorithm to control a height of screed 22, in response to screed control data as described herein. The screed adjusting algorithm may be executed in parallel with, or as a sub-routine of a smoothness estimating algorithm which may be used to determine the smoothness value. In still other embodiments, the position of screed 22 might be adjusted manually, for example via operator commands to actuator 28, and the operator commands used as the screed control data both for controlling a position of screed 22 and also for calculating or otherwise determining the smoothness value.

As mentioned above, the smoothness value may also be determined based in part on an expected smoothness of a mat of material which can be achieved following compaction. In other words, the smoothness value may be based in part on an expected response of a mat of material to compactor interaction therewith. The control algorithm executed via electronic control unit 42 may thus in one embodiment include an expected response term which corresponds to an expected response of a mat of material to compactor interaction therewith, and electronic control unit 42 may be further configured via executing the smoothness estimating algorithm to determine the smoothness value for the mat of material based in part on the expected response term. The expected response term might be determined empirically. A mat of paving material of a given type could be deposited via a paving machine under a given set of conditions such as paving material temperature, average lift thickness, etc., upon a subgrade. A smoothness of the mat could then be evaluated using a profiler or the like, or the smoothness estimated based on a known smoothness of the subgrade. Then, a compactor of a given weight, at a constant speed, drum vibration frequency, direction, etc., could be passed across the mat of paving material, and its smoothness evaluated again using a profiler or the like. The process could be repeated as necessary until an increase in smoothness in response to compacting with the compactor can be quantified. For example, a multiplier corresponding to a percentage improvement in smoothness for each pass with a compactor under a given set of compactor operating conditions might be empirically determined and used as the expected response term.

Figure 3:
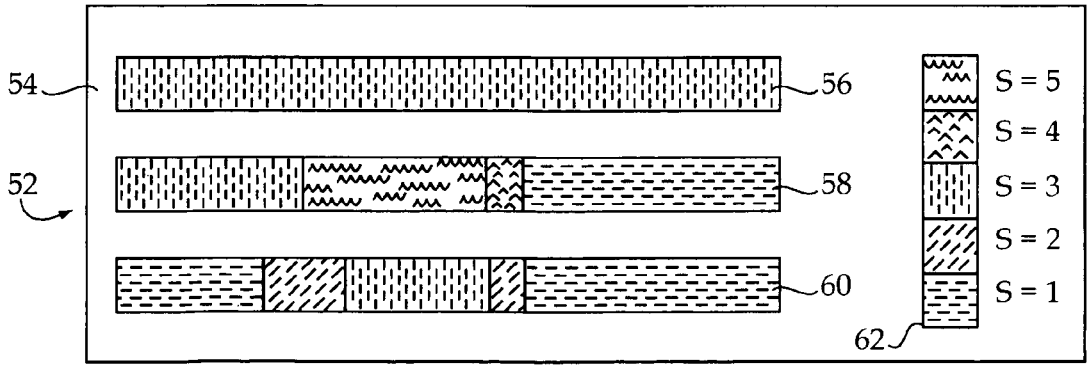
FIG. 3 is a diagrammatic view of a display for a paving system, according to one embodiment.

It will be recalled that the smoothness value(s) for a region of a mat of paving material, or other information relating to the smoothness values, may be communicated to an operator of paving machine 11. Turning now to FIG. 3, there is shown an example graphic display on a display screen 54 of display 52. In the example embodiment shown in FIG. 3, three different graphics 56, 58 and 60 are shown. Each of graphics 56, 58 and 60 corresponds to different but nonexclusive ways in which smoothness data or smoothness values for a region of a mat of material or duration of paving time can be represented to an operator, foreman, etc. In one embodiment, graphics 56, 58 and 60 might be simultaneously displayed on display screen 54. Since multiple displays, such as both of displays 52 and 53, may be used to simultaneously convey data or instructions to members of a paving crew, descriptions herein of display 52 should be understood to refer additionally or alternatively to display 53. A scale 62 wherein smoothness values "s" of s=1 to s=5 are shown, with s=1 being smoothest and s=5 being the least smooth, may be displayed on display screen 54. Each graphic 56, 58, 60 may be thought of as representing the same region or segment of a mat of material. In graphic 56, an average smoothness of s=3 for the entire mat is represented. Graphic 56 thus represents a smoothness evaluation where an average smoothness value for an overall region of the mat is calculated. Graphic 58 is segmented to indicate different smoothness values for different regions of the mat, including a smoothness value s=3 for the leftmost region, a smoothness value s=5 for a left middle region, a smoothness value s=4 for a right middle region and a smoothness value s=1 for the rightmost region. Graphic 58 differs from graphic 56 in that smoothness values are mapped to specific regions of a mat in graphic 58 whereas in graphic 56 an average smoothness value for the entire mat is calculated.

Graphic 60 represents yet another way of processing and displaying the smoothness data. In graphic 60, smoothness values for a plurality of different regions of the mat are determined based on an expected response to compactor interaction with the mat. In particular, the expected response term described above may be used to determine what increase in smoothness may be expected after compaction of the mat with a compactor. It may be noted from graphic 60 that the mat may be expected to have a smoothness value that is no greater than s=3, and is predominantly at a level that is s=1. In other embodiments, an operator, site manager, etc., might be provided with a graphic that displays an actual profile of a mat before compaction as compared to an estimated profile after compaction, for example. Rather than graphically displaying smoothness values with respect to position, smoothness values might be graphically displayed relative to elapsed paving time. In still other embodiments, smoothness values for a first lift of material might be graphically displayed in comparison with smoothness values for a second lift of material. Electronic control unit 42 could further be configured to compare the smoothness values for two different lifts of material in a given region, and output a smoothness progress signal in response to comparing the smoothness values. The smoothness progress signal might be a signal associated with an arithmetic difference between the smoothness values, a percentage increase in smoothness value, or some other quantitative or qualitative factor related to the change in smoothness from one lift of a mat to the next.

A variety of strategies for determining the smoothness value based on screed control data are contemplated herein. Sensors 36 and sensors 27 may be position sensors, and hence the corresponding input data and response data, respectively, may be position data. From this position data, velocity and acceleration of movable ski elements 34 and tow arm 26 or their associated components can be determined by way of known techniques. Electronic control unit 42 may determine a smoothness value for a region of a mat of paving material in response to any or all of position data, velocity data and acceleration data. For example, using position, if screed 22 moves vertically, without reversing direction, relative to reference plane B more than X meters, more than Y times, during paving a segment of a mat of paving material of length L, then a smoothness value of a given magnitude might be assigned. In an example embodiment using velocity, the average vertical velocity of screed 22 relative to reference plane B and the average vertical velocity of movable ski elements 34 relative to reference plane A might each be calculated over the course of a paving time duration, such as $t_0$-$t_6$ in the FIG. 2 example. If the average vertical velocity over the course of the paving time duration for both screed 22 and movable ski elements 34 exceed threshold values, then a certain smoothness value might be assigned. A root mean square of vertical velocity of screed 22 might also be calculated, for example, and used as, or in determining, the smoothness value.

In one practical implementation strategy, acceleration may be used to determine the smoothness value. As mentioned above, position signals from sensors 36 and 27 may be used to calculate acceleration of screed 22 in a vertical direction, for example, or acceleration of movable ski elements 34 in a vertical direction, for example. Since acceleration of screed 22 or ski elements 34 can be expected to relate to the frequency and steepness of bumps and dips, etc., in a paving material mat, acceleration values may be indicative of or at least correlated with smoothness. Since both velocity and acceleration of screed 22 and movable ski elements 34 in a vertical direction may depend in part on forward travel speed of paving machine 11, it may be necessary to account for paving machine travel speed when determining the smoothness value based on velocity or acceleration. During paving a segment of a mat of material of length L, for example, the standard deviation of the acceleration of screed 22 in a vertical direction relative to a reference such as reference plane B might be calculated, for example, as further described herein, to obtain the smoothness value.

In still another example embodiment, an area defined by a curve corresponding to screed control data might be calculated to determine a smoothness value. In this example, smoothness of a given region of a mat of paving material or smoothness during a selected duration of paving time may be estimated by calculating an area of deviation defined by a curve corresponding to screed control data. In particular, a baseline reference such as the line corresponding to reference plane A in FIG. 2 may be established and an area of deviation of line Y from the line corresponding to reference plane A calculated to arrive at a smoothness value. In FIG. 2, a first area of deviation $Q_1$ shown via stippling is defined by line Y relative to the line corresponding with reference plane A and is indicative of a smoothness of a region of a mat of material paved during time increment $t_0$-$t_1$. A second, larger area of deviation, the sum of areas $Q_2$ and $Q_3$, is indicative of a smoothness of a region of a mat of material paved during time increment $t_1$-$t_2$. In general, a larger area of deviation can be expected to indicate relatively rougher paving and a smaller area of deviation can be expected to indicate relatively smoother paving. In the illustrated embodiment, the area of deviation defined by line Y in time increment $t_0$-$t_1$ is less than the area of deviation defined by line Y in time increment $t_1$-$t_2$, and the results of paving during time increment $t_0$-$t_1$ can be expected to be relatively smoother than the results of paving during time increment $t_1$-$t_2$. Calculation of the area defined by line Y relative to a reference such as the line corresponding with reference plane A in FIG. 2 may be performed via known techniques. The inverse of the areas of deviation per selected time increments may also be calculated to arrive at the numerical estimate of smoothness. It should be appreciated that rather than time increments, geographic position data might be used, thus $t_0$-$t_6$ might represent different segments of a paving material mat.

INDUSTRIAL APPLICABILITY

Figure 4:
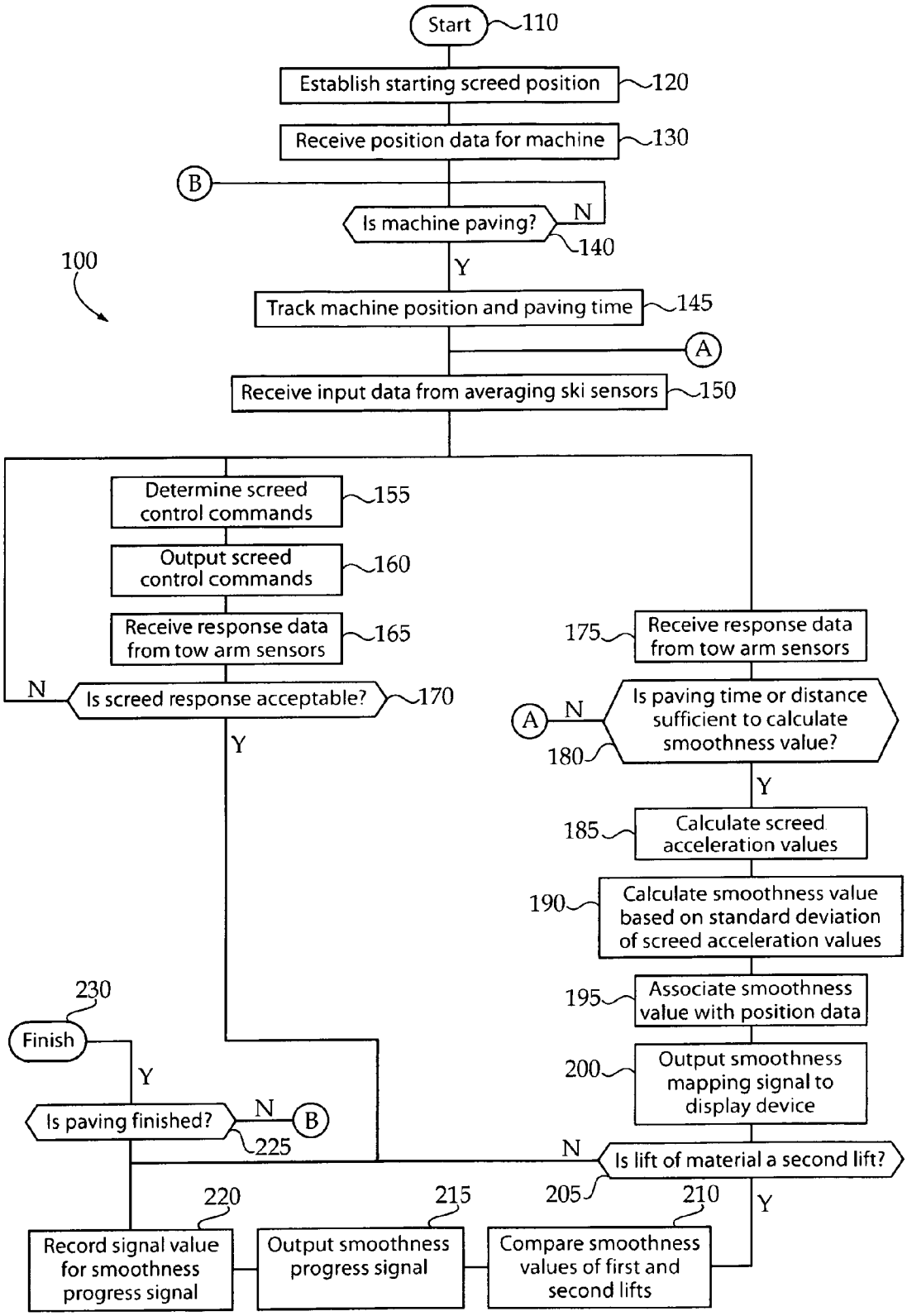
FIG. 4 is a flowchart illustrating a control process, according to one embodiment.

Referring to FIG. 4, there is shown a flowchart 100 illustrating an example control process according to the present disclosure. The process of flowchart 100 may start at step 110, and may thenceforth proceed to step 120 to establish a starting screed position. Establishing a starting screed position may include establishing a screed height relative to a reference position, establishing a screed angle of attack, etc. The starting screed position may also be based on a desired paving material thickness for a region of a work area, such as a segment of a road, where paving machine 11 will be working. From step 120, the process may proceed to step 130 to receive position data for paving machine 11, and thenceforth to step 140 where electronic control unit 42 may query whether paving machine 11 is paving. If no, the process may return to execute step 140 again. If yes, the process may proceed ahead to step 145 to commence tracking machine position and paving time.

At step 145, electronic control unit 42 may establish a global or local position of paving machine 11 via receipt of position data from receiver 50, for example. To track paving time, electronic control unit 42 may activate a timer or receive timing signals for example. From step 145, the process of flowchart 100 may proceed to step 150 where electronic control unit 42 receives input data from averaging ski sensors 36. From step 150, the process may proceed in parallel to execute a first path from step 155 to step 170 and a second path from step 175 to step 220. The first path may include the process of determining screed control commands, and may correspond with the screed adjusting algorithm discussed above.

In step 155, electronic control unit 42 may determine screed control commands in response to the input data from averaging ski sensors 36. From step 155, the process may proceed to step 160 where electronic control unit 42 may output the screed control commands. From step 160, the process may proceed to step 165 where electronic control unit 42 may receive response data from tow arm sensors 27. Thenceforth, the process may proceed to step 170 wherein electronic control unit 42 may query whether screed response is acceptable. If no, the process may return to execute steps 155-170 again. If yes, the process may proceed ahead to step 225.

Steps 175-220, the second path, may include the process of determining the smoothness value, and may correspond with the smoothness estimating algorithm discussed above. In step 175, electronic control unit 42 may receive response data from tow arm sensors 27. From step 175, the process may proceed to step 180 where electronic control unit 42 may query whether paving time or distance is sufficient to calculate a smoothness value. If no, the process may return to receive input data again via step 150. If yes, the process may proceed ahead to step 185 wherein electronic control unit 42 may calculate screed acceleration values. It will be recalled that data from sensors 36 and response data from sensors 27 may include or be processed to include at least one of position data, velocity data and acceleration data. In one practical implementation strategy, both the input data and the output data may include position data, from which acceleration data may be calculated via known techniques. It will further be recalled that electronic control unit 42 may use the input data, the output data, both the input data and output data and even the screed control commands themselves to determine the smoothness value, as any of these data sets might be used to calculate screed acceleration values. It is contemplated that a greater amount of data will tend to correspond with more accurate calculations, and hence electronic control unit 42 may utilize all of the available data sources to determine the screed acceleration values. It should be appreciated that screed acceleration values might be determined periodically, such as every few seconds, or monitored substantially continuously during paving.

From step 185, the process may proceed to step 190 wherein electronic control unit 42 may calculate the smoothness value based on the standard deviation of the screed acceleration values. Thus, in one embodiment the smoothness value might be the standard deviation of the screed acceleration values, in other words the smoothness value might be a number such as "x" meters per second squared. The smoothness value could also be or be based upon a root mean square of acceleration, an average acceleration, even a range of acceleration or still another value. It will further be recalled that machine position and paving time are being tracked. Accordingly, electronic control unit 42 can associate the smoothness value with position data received via receiver 50, or may associate the smoothness value with an elapsed paving time, for example.

From step 190, the process may proceed to step 195 where electronic control unit 42 will associate the smoothness value with position data. From step 195, the process may proceed to step 200 where electronic control unit 42 can output a smoothness mapping signal to display device 52 to display one of the previously discussed graphics, or another graphic, to an operator. It should be appreciated that rather than displaying real time smoothness information to an operator, the smoothness mapping information might be transmitted to a remote control station or worksite office, or it might simply be logged for future reference as described herein. From step 200, the process may proceed to step 205 where electronic control unit 42 may query whether the present lift of material is a second lift. If no, the process may proceed ahead to step 225. If yes, the process may proceed to step 210 where electronic control unit 42 will compare the smoothness values for the first and second lifts. The smoothness value for a first lift may be based on a first set of screed control data, whereas the smoothness value for the second lift may be based on a second, additional set of screed control data. From step 210, the process may proceed to step 215 where electronic control unit 42 may output a smoothness progress signal. From step 215, the process may proceed to step 220 where electronic control unit 42 may record a signal value for the smoothness progress signal, for example on memory 48 via memory writing device 46. The smoothness progress signal might also be transmitted to display 52, or to a remote control station or the like. From step 220 the process may proceed to step 225. In step 225, electronic control unit 42 may query whether paving is finished. If no, the process of flowchart 100 may return to execute step 140 again, and thenceforth loop back to execute both control routines, or paths, again. If yes, the process may proceed to step 230 to finish.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. While much of the foregoing description emphasizes gathering and processing data, rather than acting upon the data, it should be appreciated that a variety of actions may be taken in paving system 10 in response to the determined smoothness value. For instance, embodiments are contemplated where an operator or control unit could command specific machine actions such as slowing machine 1, speeding up machine 11, adjusting screed position, angle, screed heating, etc., where real time or predicted future smoothness of the mat appears to be within smoothness specifications, or appears to be deviating from specifications. In still other embodiments, the present disclosure may be applicable in validation of certain control strategies which are aimed at achieving a certain smoothness, or have goals not specifically directed at smoothness apart from avoiding reductions in paving quality. Other aspects, features and advantages will be apparent upon an examination of the attached drawings and appended claims.

What is claimed is:

1. A method of operating a paving system comprising the steps of:

outputting screed control commands from an electronic control unit of the paving system to vary a position of a paving machine screed relative to a reference position during paving a mat of paving material;

receiving screed control data with a receiver of the paving system coupled with the electronic control unit, the screed control data being indicative of an irregular pattern of screed position assumed in response to the screed control commands, and including data indicative of a profile of deposited paving material positioned coincident with the screed; and determining a smoothness value via the electronic control unit, responsive to the screed control data, for a region of a mat of paving material which corresponds with the irregular pattern of screed position.

2. The method of claim 1 wherein the step of receiving includes receiving data from at least one sensor resident on the paving machine.

3. The method of claim 2 wherein the step of receiving further includes receiving at least one of, input data for determining screed control commands for controlling the screed and response data indicative of a response of the screed to the screed control commands.

4. The method of claim 3 wherein the step of receiving further includes receiving the input data from a plurality of averaging ski sensors of the paving machine, the method further comprising a step of outputting the screed control commands responsive to the input data.

5. The method of claim 4 wherein the step of receiving includes receiving the response data from at least one screed tow arm sensor of the paving machine, and wherein the step of determining a smoothness value includes determining the smoothness value based in part on the input data and in part on the response data.

6. The method of claim 5 wherein the step of receiving further includes receiving at least one of, velocity data, acceleration data and position data.

7. The method of claim 2 wherein the step of determining a smoothness value further comprises determining an expected smoothness value based also in part on an expected response of the mat of material to compactor interaction therewith.

8. The method of claim 2 further comprising the steps of:

paving a surface with the mat of material, including paving the surface with a first lift of paving material and paving the surface with a second lift of paving material, wherein the step of determining a smoothness value includes determining a smoothness value for the first lift of paving material; and receiving additional screed control data indicative of an irregular pattern of screed position relative to a reference position during paving the surface with the second lift of paving material, and determining a smoothness value for the second lift of paving material, in response to the additional screed control data.

9. The method of claim 8 further comprising the steps of comparing the smoothness value for the first lift of material with the smoothness value for the second lift of material, and outputting a smoothness progress signal based on comparing the smoothness values.

10. The method of claim 2 further comprising the steps of receiving position data associated with the region of the mat of material which corresponds with the smoothness value and outputting a smoothness mapping signal based on the position data and the corresponding smoothness value.

11. A paving control system comprising:

a receiver configured to receive screed control data indicative of a plurality of different positions at a plurality of different times of a height adjustable screed of a paving machine relative to a reference position during paving a surface;

a computer readable memory storing a control algorithm comprising computer executable code; and an electronic control unit coupled with the receiver and with the computer readable memory, the electronic control unit being configured via executing the control algorithm to determine a smoothness value for a region of a mat of material which corresponds with an irregular pattern of screed position defined by the plurality of different positions at the plurality of different times, in response to the screed control data;

wherein the screed control data further includes data indicative of a profile of paving material deposited on the surface and positioned coincident with the screed, and the electronic control unit being further configured to determine the smoothness value responsive to the data indicative of a profile.

12. The paving control system of claim 11 wherein the receiver is further configured to receive position data associated with the region of the mat which corresponds with the smoothness value, and wherein the electronic control unit is configured via executing the control algorithm to output a smoothness mapping signal based on the smoothness value and the position data.

13. The paving control system of claim 11 wherein the control algorithm further includes a smoothness estimating algorithm and a screed adjusting algorithm, the electronic control unit being configured via executing the smoothness estimating algorithm to determine the smoothness value, and further configured via executing the screed adjusting algorithm to control a height of the screed, in response to the screed control data.

14. The paving control system of claim 13 wherein the control algorithm includes an expected response term corresponding to an expected response of the mat of material to compactor interaction therewith, the electronic control unit being further configured via executing the smoothness estimating algorithm to determine the smoothness value for the mat of material based in part on the expected response term.

15. The paving control system of claim 11 further comprising a set of sensors coupled with the receiver and configured to output the screed control data, including a first subset of sensors configured to couple with an averaging ski of the paving machine and a second subset of sensors configured to couple with a screed tow arm of the paving machine.

16. A paving system comprising:

a machine including a frame and a height adjustable screed coupled with the frame;

a receiver configured to receive screed control data indicative of an irregular pattern of screed position relative to a reference position, for the height adjustable screed;

a set of screed height actuators coupled with the height adjustable screed; and an electronic control unit configured to output control commands to the screed height actuators to vary a position of the screed relative to a reference position, the electronic control unit further being in communication with the receiver and configured to receive the screed control data during paving a surface with a mat of material via the paving system, and the electronic control unit being further configured to determine a smoothness value for a region of the mat of material which corresponds with the irregular pattern of screed position and includes material of the mat positioned coincident with the screed, in response to the screed control data, and to output a signal based on the smoothness value.

17. The paving system of claim 16 wherein the machine includes a paving machine having a frame, a plurality of ground engaging elements coupled with the frame and a tow arm coupling the screed with the frame.

18. The paving system of claim 17 wherein the paving machine includes a set of sensors resident thereon and configured to sense a parameter associated with the screed control data.

19. The paving system of claim 18 further comprising a display coupled with the electronic control unit, wherein the receiver is configured to receive position data associated with the region of the mat of material, and wherein the electronic control unit is configured to output a smoothness mapping signal to the display, in response to the smoothness value and the position data.

20. The paving system of claim 16 further comprising a computer readable memory coupled with the electronic control unit and configured to store a first smoothness value for a first lift of paving material and a second smoothness value for a second lift of paving material, wherein the electronic control unit is configured to compare the first smoothness value with the second smoothness value and includes a memory writing device for recording a smoothness progress value on the computer readable memory in response to comparing the first and second smoothness values.

* * * * *